US008413297B2

(12) United States Patent
Callentine et al.

(10) Patent No.: US 8,413,297 B2
(45) Date of Patent: Apr. 9, 2013

(54) APPARATUS AND METHOD PERTAINING TO A PIVOTING BARRIER

(75) Inventors: Donald Richard Callentine, Plainfield, IL (US); Anthony Thomas Iacovetti, Downers Grove, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 487 days.

(21) Appl. No.: 12/331,964

(22) Filed: Dec. 10, 2008

(65) Prior Publication Data

US 2010/0139188 A1 Jun. 10, 2010

(51) Int. Cl.
*E05F 3/22* (2006.01)

(52) U.S. Cl.
USPC ..... 16/68

(58) Field of Classification Search ..... 52/71; 16/86.1, 16/86.2, 50, 54, 68, 71, 72, 286
See application file for complete search history.

(56) References Cited

U.S. PATENT DOCUMENTS

| | | | | |
|---|---|---|---|---|
| 216,777 | A * | 6/1879 | Barry | 16/286 |
| 1,350,134 | A * | 8/1920 | Bellican | 16/72 |
| 1,492,257 | A * | 4/1924 | Moore | 16/286 |
| 1,578,780 | A * | 3/1926 | Titus | 16/299 |
| 1,645,977 | A * | 10/1927 | Titus | 16/286 |
| 1,903,923 | A * | 4/1933 | Hyde | 16/50 |
| 2,563,894 | A | 8/1951 | White | |
| 3,287,757 | A * | 11/1966 | Van Noord | 16/291 |
| 3,572,223 | A | 3/1971 | Vierregger | |
| 4,367,610 | A | 1/1983 | Goode | |
| 4,430,638 | A | 2/1984 | Parker | |
| 4,489,306 | A | 12/1984 | Scolari | |
| 4,531,325 | A | 7/1985 | Phillips | |
| 4,870,543 | A | 9/1989 | Born et al. | |
| 4,893,119 | A | 1/1990 | Nasatka | |
| 4,934,203 | A | 6/1990 | Bailey et al. | |
| 5,035,082 | A | 7/1991 | Butler | |
| 5,133,152 | A | 7/1992 | Grancagnolo | |
| 5,136,813 | A | 8/1992 | Gibbs et al. | |
| 5,373,664 | A | 12/1994 | Butler | |
| 5,394,651 | A | 3/1995 | Vial | |

(Continued)

FOREIGN PATENT DOCUMENTS

| | | |
|---|---|---|
| EP | 0443052 | 2/1990 |
| FR | 2586745 A1 * | 3/1987 |

OTHER PUBLICATIONS

LiftMaster Professional Owners Manual Model LA400, 2007, 32 pages.
LiftMaster Professional Addendum to LA400 Owner's Manual, 2006, 2 pages.

*Primary Examiner* — Christine T Cajilig
(74) *Attorney, Agent, or Firm* — Fitch Even Tabin & Flannery LLP

(57) ABSTRACT

An apparatus for use with a post (602) and a corresponding pivoting barrier (601) comprises a post-mountable bracket (300) and a pivoting barrier-mountable bracket (500). The former comprises a frame (301) configured to be affixed to the post, a barrier pivot (305) that is affixed to the frame, and a linear actuator arm mounting bracket (307) that is also affixed to the frame. The pivoting barrier-mountable bracket can comprise a frame (501) configured to be affixed to the pivoting barrier, a post pivot (505) that is affixed to the frame and that is configured to pivotally mate with the barrier pivot, and a linear actuator arm mounting bracket (507).

18 Claims, 4 Drawing Sheets

U.S. PATENT DOCUMENTS

| | | | | |
|---|---|---|---|---|
| 5,499,887 | A | 3/1996 | Verra | |
| 5,500,642 | A | 3/1996 | Battle | |
| 5,804,938 | A | 9/1998 | Richmond et al. | |
| 5,829,913 | A | 11/1998 | Puckett | |
| 5,869,940 | A * | 2/1999 | Parsadayan | 318/461 |
| 6,364,374 | B1 * | 4/2002 | Noone et al. | 285/424 |
| 6,487,818 | B1 | 12/2002 | Hamann et al. | |
| 6,650,076 | B1 | 11/2003 | Hom et al. | |
| 6,712,547 | B1 | 3/2004 | Shauf, Sr. et al. | |
| 6,742,303 | B2 | 6/2004 | Pedemonte | |
| 6,883,275 | B2 | 4/2005 | Hellinga et al. | |
| 6,935,000 | B1 | 8/2005 | Arnaud | |
| 7,000,355 | B2 | 2/2006 | Flory et al. | |
| 7,107,722 | B2 | 9/2006 | Casali et al. | |
| 7,146,766 | B2 * | 12/2006 | Finkelstein | 49/324 |
| 7,287,929 | B1 | 10/2007 | Sokolowski et al. | |
| 7,367,161 | B1 | 5/2008 | Jones | |
| 7,472,891 | B2 | 1/2009 | Schram et al. | |
| 7,958,675 | B2 | 6/2011 | Stull | |
| 2001/0037600 | A1 | 11/2001 | Hormann | |
| 2003/0015980 | A1 | 1/2003 | Richmond et al. | |
| 2004/0145332 | A1 | 7/2004 | Hom et al. | |
| 2004/0177558 | A1 | 9/2004 | Parsadayan et al. | |
| 2007/0075655 | A1 | 4/2007 | Van Drunen et al. | |
| 2007/0221904 | A1 | 9/2007 | Stull | |
| 2010/0139170 | A1 | 6/2010 | Planck et al. | |
| 2010/0139188 | A1 | 6/2010 | Callentine | |
| 2010/0223853 | A1 | 9/2010 | Daniel-Wayman | |

* cited by examiner

100

APPARATUS AND METHOD PERTAINING TO A PIVOTING BARRIER

RELATED APPLICATION(S)

This application is related to co-owned U.S. patent application Ser. No. 12/331,978, entitled APPARATUS AND METHOD PERTAINING TO A PRE-CONFIGURED POST FOR USE WITH AN AUTOMATICALLY-MOVABLE BARRIER and filed on even date herewith, which is incorporated by reference in its entirety herein.

TECHNICAL FIELD

This invention relates generally to movable barriers and more particularly to pivoting movable barriers.

BACKGROUND

Movable barriers of various kinds are known in the art. These include pivoting barriers such as, but not limited to, gates and carriage house garage doors of various kinds that pivot at one end thereof with respect to a support component. It is also known to employ a barrier operator (such as, but not limited to, a linear actuator) to control the automatic movement of the pivoting barrier. Such an approach can serve, for example, to permit the automatic opening and closing of the pivoting barrier.

It is known that an operator such as a linear actuator should be coupled such that the linear actuator is usually not parallel to the barrier itself. Such a configuration ensures that the linear actuator is actually able to exert the desired influence upon the barrier. It is also known to change the speed and/or acceleration at which the linear actuator retracts or extends in order to appropriately control the speed at which the barrier itself moves. Unfortunately, barrier speeds (as well as other operational physicalities such as experienced forces) at a given actuator speed of acceleration can vary dramatically with respect to the physical dimensions of the installation (for example, to a large extent, the speed of the barrier (or the forces being experienced by the barrier) at any given moment comprises a function of the angle between the barrier and the linear actuator arm). This variability is dynamic and can and will change over the course of the barrier's path of movement.

Accordingly, as great unpredictability can exist with respect to the physical dimensions that can result with respect to a given installation setting, corresponding significant uncertainty exists with respect to the actual resultant speeds a given pivoting barrier will experience through its path of travel. This, in turn, can lead to end user dissatisfaction, maintenance issues, operating difficulties, and so forth.

BRIEF DESCRIPTION OF THE DRAWINGS

The above needs are at least partially met through provision of the apparatus and method pertaining to a pivoting barrier described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, an apparatus for use with a post and a corresponding pivoting barrier comprises a post-mountable bracket and a pivoting barrier-mountable bracket. The former comprises a frame configured to be affixed to the post, a barrier pivot that is affixed to the frame, and a linear actuator arm mounting bracket that is also affixed to the frame. The pivoting barrier-mountable bracket can comprise a frame configured to be affixed to the pivoting barrier, a post pivot that is affixed to the frame and that is configured to pivotally mate with the barrier pivot, and a linear actuator arm mounting bracket.

So configured, important dimensions are rendered stable and known before, during, and after the installation process. This includes the relative angle between the barrier and the linear actuator arm (in the fully-closed position, the fully-opened position, and each position in-between). Accordingly, notwithstanding the physical variations that characterize a given installation setting, these teachings tend to ensure a considerable amount of consistency with respect to dimensions that in turn greatly influence the expected speeds at which the barrier moves when shifting between closed and opened positions.

Those skilled in the art will appreciate that these benefits accrue in an economical manner and are relatively foolproof. As a result, installers require little (if any) corresponding training to ensure proper use of the disclosed apparatus when installing a given pivoting barrier. It will also be appreciated that these teachings are highly scalable and can be employed in a wide variety of different application settings.

Figure 1:
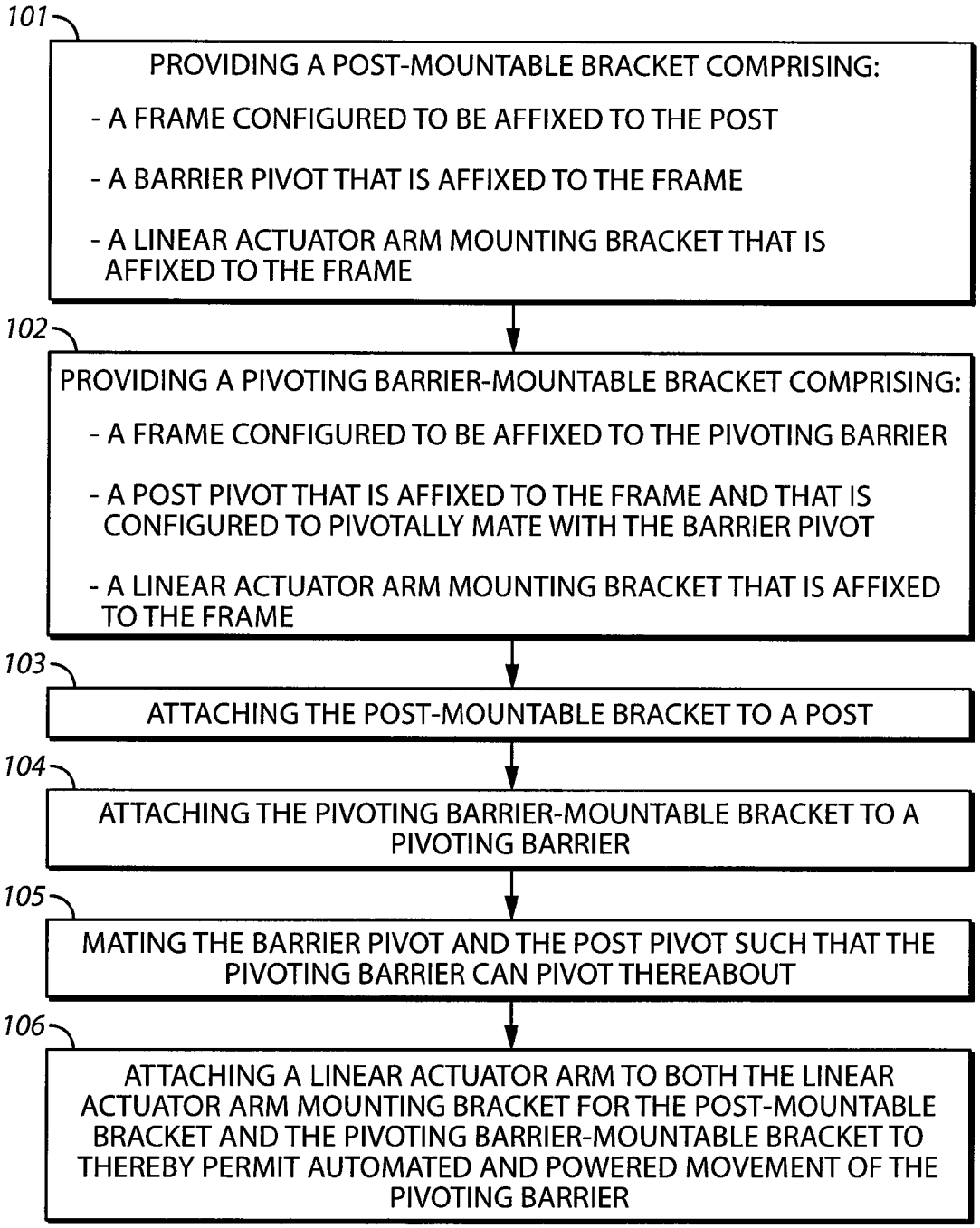
FIG. 1 comprises a flow diagram as configured in accordance with various embodiments of the invention.

These and other benefits may become clearer upon making a thorough review and study of the following detailed description. Referring now to the drawings, and in particular to FIG. 1, an illustrative process that is compatible with many of these teachings will now be presented. This process 100 comprises a particular approach to pivotally associating a pivoting barrier to a corresponding post. (For the purposes of illustration in the following description, this "post" will be presumed to comprise a long dowl-like member (having a circular or rectangular cross section) that protrudes from the ground. As used herein, however, this term will also be understood to include structures that serve a similar functional purpose in these regards, such as, but not limited to, the end of a metal, wooden, stone, or brick material fence.)

Figure 2:
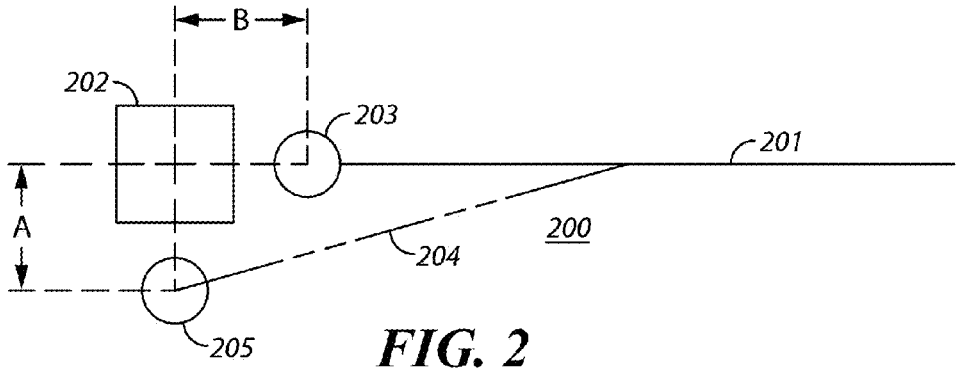
FIG. 2 comprises a top plan schematic view as configured in accordance with various embodiments of the invention.

It may be helpful to note that this process 100 can be employed to achieve a particular desired predetermined geometry as pertains to the pivotal coupling of the pivoting barrier to the aforementioned post. Referring momentarily to FIG. 2, the pivoting barrier 201 will pivotally couple to the post 202 at a corresponding pivot point 203. In turn, a linear actuator arm 204 will couple between the pivoting barrier 201 and a corresponding fixed point 205 as corresponds to the post 202. So configured, as the linear actuator arm 204 shortens in length the pivoting gate 201 will be pivoted (in this illustration) clockwise. The applicant has determined that a desired physical geometry is for the dimension denoted as "A" to equal the dimension denoted as "B." When such is the case, the speed and forces of the pivoting gate 201 will tend to be sufficiently predictable and symmetrical (for example, these operating parameters will tend to be more symmetrical with respect to the first half of the path of travel and the second half of the path of travel) and hence permit the development and use of correspondingly reliable operating strategies in these regards. As will be shown below, the present teachings are considerably helpful in these regards.

Figure 3:
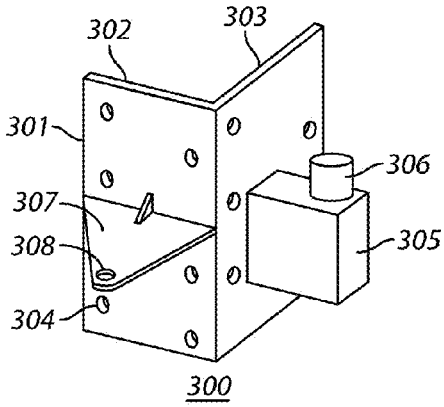
FIG. 3 comprises a perspective view as configured in accordance with various embodiments of the invention.

Referring now to both FIGS. 1 and 3, this process 100 includes the step 101 of providing a post-mountable bracket 300. This post-mountable bracket 300 comprises a frame 301 that itself can comprise as illustrated an L-shaped member where each leg 302 and 303 is configured to be affixed to the post. (Those skilled in the art will recognize that this L-shaped form factor is presented for its illustrative value and is not intended to be limitation with respect to these teachings. Numerous other shapes (such as, for example, a "U" shape or a "J" shape) can be considered and may, in fact, offer superior performance in a given application setting.) This frame 301 can be comprised of a suitable material (likely a sturdy metal such as steel or iron though other metals (such as aluminum) or alloys (or even sturdy plastic materials) may suffice for some application settings. By one approach, one or both legs 302 and 303 can have one or more holes 304 disposed therethrough to receive an affixment member (such as, but not limited to, a nail, a screw, a bolt, a brad, a tack, and so forth) to thereby affix the frame 301 to the post. Depending upon the application setting, other affixment choices might suffice as well, such as adhesives of various kinds, magnets, binding straps, and so forth.

This post-mountable bracket 300 also comprises a barrier pivot 305 that is affixed to the frame 301. As used herein, this "affixment" will be understood to comprise a direct affixment such as might be achieved through molding these elements as a common, integral component, or by some permanent means of affixment such as welding. By one approach, and as illustrated, this barrier pivot 305 includes a pivot pin 306.

This post-mountable bracket 300 further comprises a linear actuator arm mounting bracket 307 that is also affixed to the frame 301. This linear actuator arm mounting bracket 307 comprises, in this example, a substantially planar member that extends outwardly of the frame and that has a hole 308 disposed therethrough near its end. This hole 308 serves as a point at which a linear actuator arm can be connected in a manner known in the art.

Figure 4:
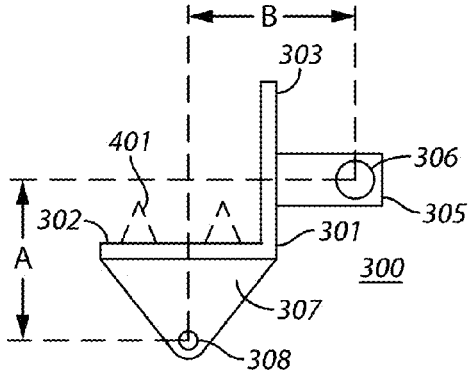
FIG. 4 comprises a top plan view as configured in accordance with various embodiments of the invention.

Referring now to FIG. 4 as well as FIG. 3, it will be noted and appreciated that the pivot pin 306 and the linear actuator arm mounting bracket 307 are disposed substantially at a right angle with respect to one another with each being connected to a different one of the frame's legs 303 and 302, respectively. It will also be noted that by choosing the dimensions of these elements appropriately, the aforementioned dimensions "A" and "B" can be made substantially equal to one another (though being exactly equal may represent an optimum result, acceptable results should result in many application settings if these dimensions are nearly, if not exactly, equal to one another). In fact as long as the ratio is known the system can be readily designed to compensate for dimensional variations to achieve the desired force and speed performance.

FIG. 4 also serves to illustrate an optional configuration. In particular, and if desired, the frame 301 can include one or more spikes 401 that are disposed and configured to penetrate the post when the post-mountable bracket 300 is installed on a post to thereby aid in affixing the frame to the post. Such a spike 401 can be comprised, for example, of the same material as the frame 301 itself and can be formed by forming a V-shaped cutaway in the frame 301 and then bending the frame material outwardly to direct the corresponding spike 401 in the desired direction.

Figure 5:
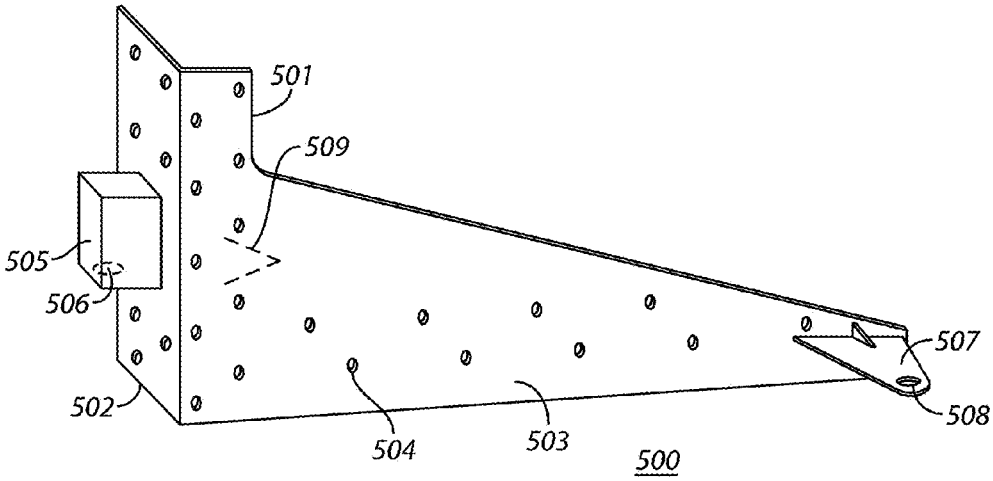
FIG. 5 comprises a perspective view as configured in accordance with various embodiments of the invention.

Referring again to FIG. 1 and now as well to FIG. 5, this process 100 also includes the step 102 of providing a pivoting barrier-mountable bracket 500. This pivoting barrier-mountable bracket 500 also comprises a frame 501 that may comprise (as illustrated) an L-shaped frame where each leg 502 and 503 is configured to be affixed to a pivoting barrier. (As with the post-mountable bracket 300 described above, this L-shaped frame serves an illustrative purpose and other form factors may of course be used as desired.) Again, this pivoting barrier-mountable bracket 500 can have one or more holes 504 disposed therethrough to receive an affixment member to thereby affix the pivoting barrier-mountable bracket 500 to the pivoting barrier. Also as with the post-mountable bracket 300, and again optionally, the pivoting barrier-mountable bracket 500 can have one or more V-shaped cutaways 509 to thereby permit a corresponding spike to be formed and pushed inwardly to engage the pivoting barrier and thereby aid in affixing the pivoting barrier-mountable bracket 500 to the pivoting barrier.

By one approach, the frame 501 of the pivoting barrier-mountable bracket 500 can have a post pivot 505 affixed thereto. This post pivot 505 can itself comprise a block having a pivot pin receiver 506 (such as, for example, a hole) formed therein. In this embodiment the post pivot 505 is affixed to a first leg 502 of the frame 501 while the remaining leg 503 has a linear actuator arm mounting bracket 507 affixed thereto. The linear actuator arm mounting bracket 507 (which can comprise a substantially planar member that extends outwardly of the frame 501), in turn, has a hole 508 disposed therethrough to couple to the aforementioned linear actuator arm in a known manner.

As with the post-mountable bracket 300, the pivoting barrier-mountable bracket 500 can be comprised of a suitably strong and durable material.

Figure 6:
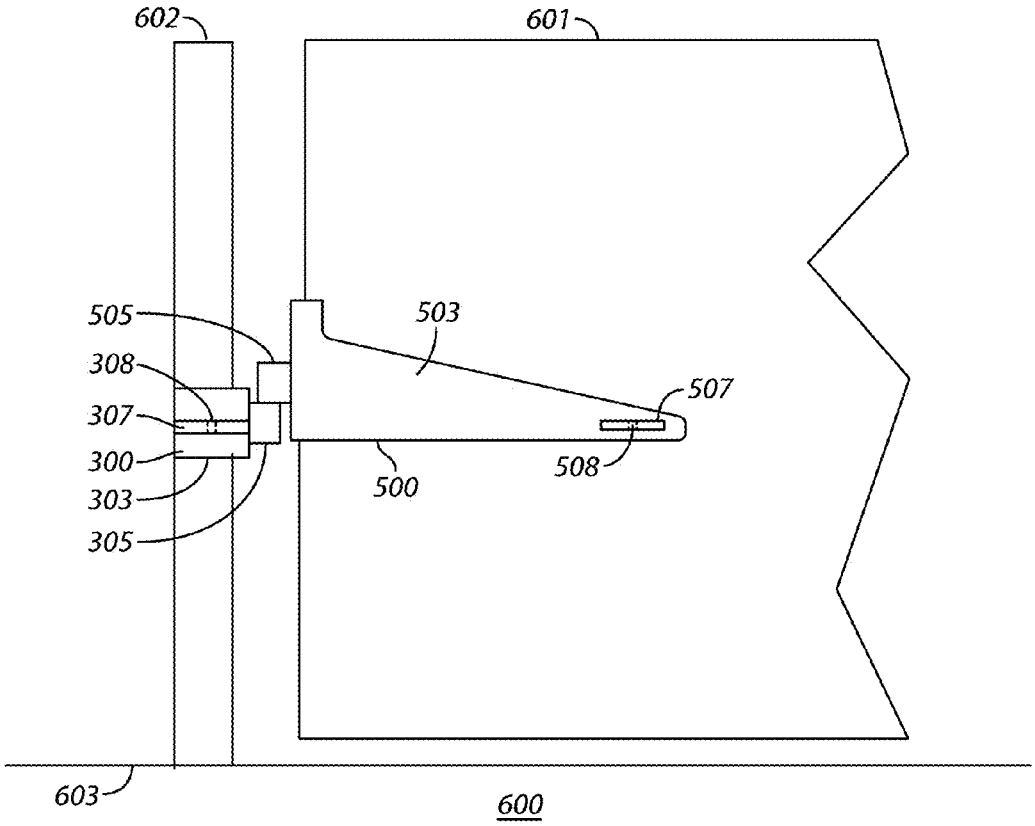
FIG. 6 comprises a front elevational schematic view as configured in accordance with various embodiments of the invention.

Referring now to FIGS. 1 and 6, and presuming the availability of a pivoting barrier 601 and a corresponding post 602, this process 100 includes the step 103 of attaching the post-mountable bracket 300 to the post 602. By one approach, this can comprise using one or more affixment members (such as wood screws when the post 602 comprises a wooden dowel having a square cross section) that are disposed through corresponding holes in the legs 302 and 302 of the post-mountable bracket 300 to secure the latter to the post 602. The location of the post-mountable bracket 300 on the post 602 will be generally dependent upon the specifics of the pivotal barrier 601 itself. In some cases, as shown, this may prompt installing the post-mountable bracket 300 at an approximate midpoint of the post 602. In other application settings an installation location higher, or lower, may be preferable.

In any event, this process 100 also includes the step 104 of attaching the pivoting barrier-mountable bracket 500 to the pivoting barrier 601. As with the post-mountable bracket 300, this can comprise attaching the pivoting barrier-mountable bracket 500 using, for example, holes that are disposed through the legs of the pivoting barrier-mountable bracket 500 to receive bolts or the like. At step 105, this process 100 then provides for mating the barrier pivot 505 with the post pivot 305 such that the pivoting barrier 601 can pivot thereabout. (Those skilled in the art will recognize that a typical installation setting will employ more than one pivot point to couple the pivoting barrier 601 to the post 602. For the sake of clarity such additional pivot points are not shown in FIG. 6.)

Figure 7:
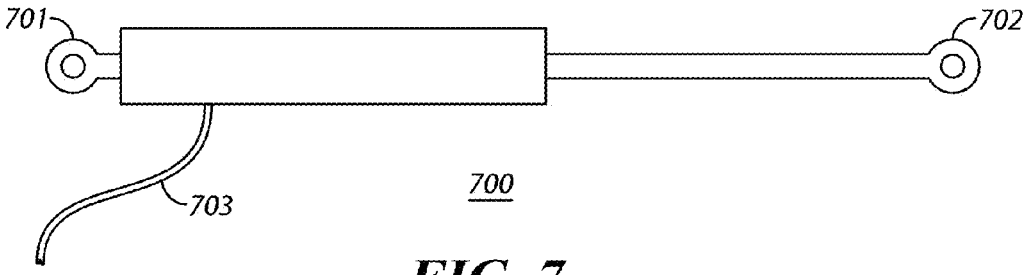
FIG. 7 Prior Art
FIG. 7 comprises a top plan view as configured in accordance with the prior art.

With reference to FIGS. 1, 6, and 7, this process 100 will then accommodate the step 106 of attaching a linear actuator arm 700 to both the linear actuator arm mounting bracket 307 (using, for example, the provided hole 308 and the engagement member 701 on one end of the arm 700) for the post-mountable bracket 300 and the linear actuator arm mounting bracket 507 (using, for example, the provided hole 508 and the engagement member 702 on the arm 700) for the pivoting barrier-mountable bracket 500 to thereby permit automated and powered movement of the pivoting barrier 601 upon applying power via a corresponding conductor 603. (Such linear actuators are well known in the art. As the present teachings are not particularly sensitive to any particular choice of actuator, for the sake of brevity no further elaboration will be provided here in these regards.)

Figure 8:
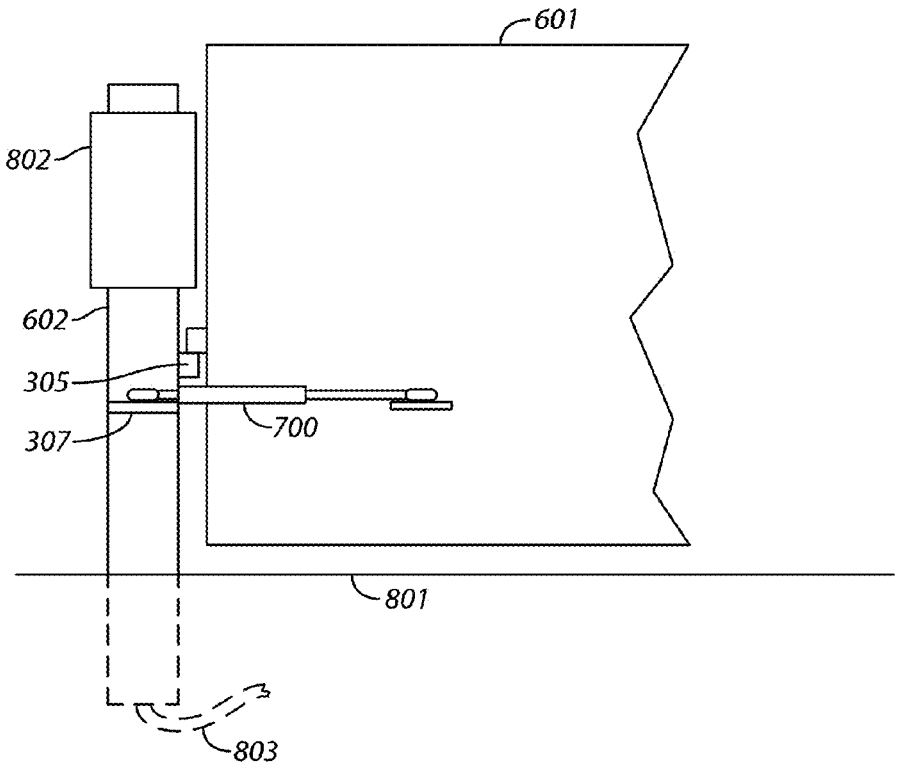
FIG. 8 comprises a front elevational schematic detail view as configured in accordance with various embodiments of the invention.

Referring now to FIG. 8, a process provides the step of installing the post 602 by burying a portion of the post 602 under the ground 801. A given post can be designed to be buried to a predetermined level (for example, to accommodate the requirements of a particular building code in a particular region, municipality, or the like).

So configured, control circuitry 802 for the barrier operator system can be conveniently mounted on the post 602 in a location that provides easy access to the mains-power bearing pathway to provide operating electrical power to the control circuitry 802. So configured, it will be recognized and appreciated that this electrical connection, in this particular embodiment, is accomplished without exposing the mains delivery pathway to view or other easy accessibility. This approach not only greatly simplifies and eases installation of the system, it is both more aesthetically pleasing and considerably more secure as well.

When the post 602 has one or more integral pivot points 305 as described above, these teachings will readily accommodate then installing the automatically-movable barrier 601 on the integral pivot point 305. In this particular example, a linear actuator arm 700 can then be appropriately connected between the post 602 (using, for example, the aforementioned integral support surface 307) and the movable barrier 601 itself. So configured, contraction and extension of the linear actuator arm 700 will cause a corresponding controlled pivoting of the movable barrier 601 about the aforementioned pivot point 305.

Those skilled in the art will recognize and appreciate a variety of benefits that correspond to such a configuration. By employing this apparatus, an installation by even a relatively inexperienced installer will nevertheless tend to ensure the desired geometry and dimensionality as described above. Furthermore, such an approach is well suited when applied in conjunction with a barrier operator having adjustable travel limits. Such adjustability, of course, ordinarily presents both opportunity and risk; the opportunity corresponds to an ability to successfully leverage the barrier operator in a variety of application settings while the risk involves, at the least, the chance that an installer will adjust those travel limits in some particularly unhelpful fashion.

Accordingly, if desired, the described process can further comprise using a barrier operator having adjustable travel limits but nevertheless proceeding without requiring an adjustment of those travel limits following the coupling of the barrier operator to the post-mountable bracket 300 and the pivoting barrier-mountable bracket 500. Such a step can be omitted because the described fixed dimensionality of this apparatus can ensure that the barrier operator installation setting is sufficiently well enough known notwithstanding that the application setting itself may vary considerably from installation to installation. This lack of a travel-limits adjustment can be set forth explicitly in the instructions that are provided to the installer or can be occasioned through omission of adjustment instructions when setting forth the installation procedure.

As another example in these regards, many barrier operators have a corresponding force profile that the operator employs during operations to achieve a particular operational result (such as a particular speed of movement, the detection of an obstacle, and so forth). In many cases the installer is provided with some opportunity to adjust such a force profile to compensate and account for particular physical nuances of a given installation. By applying these teachings in conjunction with the use of a barrier operator having adjustable force settings, however, it again becomes possible to consider modifying the describe process by again proceeding through the installation process without requiring an adjustment of the force profile as corresponds to the barrier operator if desired.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. As but one example in these regards, these teachings will accommodate using one of the described mountable brackets in conjunction with a mate that itself comprises an integral part of the post/barrier to which it corresponds. For example, the described pivoting barrier-mountable bracket 500 can be used in conjunction with a post having the described pivot and actuator support elements integrally formed therewith (as versus being connected to the post via use of a bracket form factor).

We claim:

1. An apparatus for use with a post and a corresponding pivoting barrier, the apparatus comprising:

an L-shaped frame comprising a first leg defining a first leg axis and a second leg defining a second leg axis, the L-shaped frame configured to be affixed to the post;

a barrier pivot extending from the first leg of the L-shaped frame, the barrier pivot comprising at least one barrier pivot point; and a linear actuator arm mounting bracket extending from the second leg of the L-shaped frame, the linear actuator arm mounting bracket configured to connect to a proximal end of a linear actuator arm and support the linear actuator arm at the proximal end of the arm so that the arm can pivot around an actuator arm axis extending through the linear actuator arm mounting bracket, the axis of pivot of the linear actuator arm being substantially parallel to an axis of pivot through the barrier pivot point;

the barrier pivot on the first leg and the linear actuator arm mounting bracket are configured and arranged to provide a distance A between the linear actuator arm axis of pivot and the axis of pivot through the barrier pivot point measured along the first leg axis and a distance B between the linear actuator arm axis and the axis of pivot through the barrier pivot point measured along the second leg axis which are substantially equal.

2. The apparatus of claim 1 wherein the first leg and the second leg of the L-shaped frame are configured to be affixed to the post.

3. The apparatus of claim 2 wherein the barrier pivot is attached directly to the center of the first leg of the L-shaped frame and the linear actuator arm mounting bracket is affixed directly to a second leg of the L-shaped frame.

4. The apparatus of claim 1 wherein the frame has at least one hole disposed therethrough to receive an affixment member to thereby affix the frame to the post.

5. The apparatus of claim 1 wherein the frame comprises at least one spike that is disposed and configured to penetrate the post when the apparatus is installed on the post to thereby aid in affixing the frame to the post.

6. The apparatus of claim 1 wherein the barrier pivot comprises a pivot pin.

7. The apparatus of claim 1 wherein the linear actuator arm mounting bracket comprises a substantially planar member that extends outwardly of the L-shaped frame, and the planar member has a hole disposed therethrough.

8. A pivoting barrier mountable bracket and post mounting bracket which when assembled couple a pivoting barrier to a corresponding post and form a coupling assembly which spaces the barrier from the post and aligns a linear actuator arm support surface with a post pivot attached to the post and aligns a distal pivot at a distal end of a linear actuator arm attached to the pivoting barrier with a linear actuator arm pivot attached to the post, the pivoting barrier mountable bracket comprising:

a barrier mountable frame configured to be affixed to the pivoting barrier with fasteners, the barrier bracket having a proximate end and a distal end;

a barrier mountable bracket pivot that extends from the proximal end of the barrier mountable frame to permit pivoting of the pivoting barrier;

a barrier mountable linear actuator arm mounting bracket extending from the distal end of the barrier mountable frame, the barrier mountable linear actuator arm mounting bracket configured to align the distal end of a linear actuator arm which linearly pushes and pulls the pivoting barrier between a closed and an open position when a linear actuator arm support surface mounted on the post is opposite the pivoting barrier mountable bracket mounted on the pivoting barrier; and post mounting bracket comprising:

a post mounting bracket frame configured to be affixed to the post with fasteners, the post mounting bracket frame having a first post mounting surface and a second post mounting surface;

the post pivot and a post pivot support, the post pivot support extending from the first post mounting surface, the post pivot configured to provide a barrier pivot point for the pivoting barrier;

the linear actuator arm support surface extending from the second post mounting surface at an angle which is perpendicular to the post pivot support, the linear actuator arm support surface having a linear actuator arm axis of pivot, the linear actuator arm support surface configured to couple to and support a proximal end of the linear actuator arm so that the linear actuator arm can pivot around the linear actuator arm axis of pivot which extends through the actuator arm support surface, the axis of pivot of the linear actuator arm being substantially parallel to an axis of pivot through the barrier pivot point, the linear actuator arm support surface positioning the distal end of the linear actuator arm to couple with the barrier mountable linear actuator arm mounting bracket to permit the linear actuator arm to linearly move and pivot the barrier around the post pivot between the closed and the open position.

9. The pivoting barrier mountable bracket and post mounting bracket of claim 8 wherein the post pivot and barrier mountable bracket pivot are configured to pivotally couple and space the barrier from the post pivot for pivotal movement of the barrier.

10. The pivoting barrier mountable bracket and post mounting bracket of claim 8 wherein the post pivot comprises a pivot pin and the barrier mounting bracket pivot includes a hole which receives the pivot pin.

11. The pivoting barrier mountable bracket and post mounting bracket of claim 8 wherein the linear actuator arm mounting bracket comprises a substantially planar member that extends outwardly from the distal end of the barrier mountable frame, the barrier mountable linear actuator arm mounting bracket including a hole disposed therethrough to permit the linear actuator arm to rotatably couple the distal end of the linear actuator arm to the distal end of the barrier mountable bracket.

12. An apparatus which couples a post and a corresponding pivoting barrier, the apparatus comprising:

a linear actuator arm having a proximal end and distal end;

a post-mountable bracket comprising:

an L-shaped frame comprising a first leg defining a first leg axis and a second leg defining a second leg axis, the L-shaped frame configured to be affixed to a side of the post;

a first barrier pivot extending from the first leg of the L-shaped frame, the barrier pivot having a barrier pivot point; and a first linear actuator arm mounting bracket extending from the second leg of the L-shaped frame, the first linear actuator arm mounting bracket supporting the proximal end of the linear actuator arm and the first linear actuator arm mounting bracket having a linear actuator arm pivot point which rotatably connects to the proximal end of the linear actuator arm so that the arm can pivot around an actuator arm axis extending through the linear actuator arm mounting bracket, the axis of pivot of the linear actuator arm being substantially parallel to an axis of pivot through the barrier pivot point;

the barrier pivot on the first leg and the linear actuator arm mounting bracket are configured and arranged to provide a distance A between the linear actuator arm axis of pivot and the axis of pivot through the barrier pivot point measured along the first leg axis and a distance B between the linear actuator arm axis and the axis of pivot through the barrier pivot point measured along the second leg axis which are substantially equal; and a pivoting barrier-mountable bracket comprising:

an L-shaped frame configured to be affixed to the pivoting barrier;

a post pivot that extends from a proximal end of a first leg of the L-shaped frame;

a second linear actuator arm mounting bracket extending from a distal end of a second leg of the L-shaped frame, the second linear actuator arm mounting bracket configured to couple to a distal end of a linear actuator arm which linearly pushes and pulls the pivoting barrier between a closed and an open position; and wherein the first and second linear actuator arm mounting brackets are configured such that the linear actuator arm travels in a plane substantially perpendicular to the axis of pivot of the pivoting barrier when the linear actuator arm is connected to the first and second linear actuator arm mounting brackets.

13. The apparatus of claim 12 wherein each leg of the L-shaped frame of the pivoting barrier-mountable bracket has at least one hole disposed therethrough to receive an affixment member to thereby affix the frame in an installed position.

14. The apparatus of claim 12 wherein the axis of pivot of the pivoting barrier is substantially vertical and the plane substantially perpendicular to the axis of pivot of the pivoting barrier is substantially horizontal.

15. A post mounting bracket control assembly which is configured to pivotly couple a pivoting barrier to a corresponding post, linear actuator arm and control circuitry associated with the post, the post mounting bracket control assembly comprising:

a linear actuator arm which linearly retracts and extends and configured to effect movement of a barrier between an open and closed position upon control by the control circuitry, the linear actuator arm having a proximal and distal end;

a frame configured to be affixed to the post with fasteners, the frame having a first surface and a second surface;

a post pivot and post pivot support, the post pivot support extending from a first surface of the frame, the post pivot configured to provide a pivot point for the pivoting barrier;

a linear actuator arm mounting bracket extending from the second surface of the frame at an angle which is perpendicular to the post pivot support, the linear actuator arm mounting bracket configured to couple to and support a proximal end of the linear actuator arm so that the arm can pivot around an actuator arm axis of pivot extending through the linear actuator arm mounting bracket, the axis of pivot of the linear actuator arm being substantially parallel to an axis of pivot through the barrier pivot point, the linear actuator arm mounting bracket positioning the distal end of the linear actuator arm to linearly move and pivot the barrier around the post pivot between the closed and the open position;

wherein the post pivot on the first surface and the linear actuator arm mounting bracket are configured and arranged to provide a distance A between the linear actuator arm axis of pivot and the axis of pivot through the barrier pivot point measured along the first surface axis and a distance B between the linear actuator arm axis and the axis of pivot through the barrier pivot point measured along the second surface axis which are substantially equal.

16. The pivoting barrier mountable bracket and post mounting bracket of claim 8 wherein the post pivot on the first surface and the linear actuator arm support surface and the actuator arm axis of pivot are configured and arranged to provide a distance A between the linear actuator arm axis of pivot and the axis of pivot through the barrier pivot point measured along a first post mounting surface axis which is perpendicular to a second post mounting surface axis and a distance B between the linear actuator arm axis and the axis of pivot through the barrier pivot point measured along the second post mounting surface axis are substantially equal.

17. A method of installing a pivoting moving barrier to a post attaching a post mounting bracket to a post; and attaching a pivoting barrier mounting bracket to a barrier; and attaching the barrier to the post through the post mounting bracket and pivoting barrier mounting bracket;

the pivoting barrier mountable bracket comprising:

a barrier mountable frame configured to be affixed to the pivoting barrier with fasteners, the barrier mounting bracket having a proximate end and distal end;

a barrier mounting bracket pivot that extends from the proximal end of the barrier mountable frame;

a barrier mountable linear actuator arm mounting bracket extending from the distal end of the barrier mountable frame, the barrier mountable linear actuator arm mounting bracket configured to align the distal end of a linear actuator arm which linearly pushes and pulls the pivoting barrier between a closed and an open position when a linear actuator arm support surface mounted on the post is opposite the pivoting barrier mounting bracket mounted on the barrier; and the post mounting bracket comprising:

a post mounting bracket frame configured to be affixed to the post with fasteners, the frame having a first post mounting surface and a second post mounting surface;

a post pivot and a post pivot support, the post pivot support extending from the first post mounting surface, the post pivot configured to provide a barrier pivot point for the pivoting barrier;

the linear actuator arm support surface extending from the second post mounting surface at an angle which is perpendicular to the post pivot support, the linear actuator arm support surface having a linear actuator arm axis of pivot, the linear actuator arm support surface configured to couple to and support a proximal end of the linear actuator arm so that the linear actuator arm can pivot around the linear actuator arm axis of pivot which extends through the linear actuator arm support surface, the axis of pivot of the linear actuator arm being substantially parallel to an axis of pivot through the barrier pivot point, the linear actuator arm support positioning the distal end of the linear actuator arm to couple with the barrier mountable linear actuator arm mounting bracket to permit the linear actuator arm to linearly move and pivot the barrier around the post pivot between the closed and the open position.

18. The pivoting barrier mountable bracket and post mounting bracket of claim 16 wherein the barrier mountable frame of the pivoting barrier mounting bracket has an L shape, the proximate end of the barrier mountable frame having a leg configured to engage an end edge of the pivoting barrier to set a distance the linear actuator arm would extend and contract as the barrier moves from an open and closed position.

* * * * *

UNITED STATES PATENT AND TRADEMARK OFFICE

CERTIFICATE OF CORRECTION

PATENT NO. : 8,413,297 B2
APPLICATION NO. : 12/331964
DATED : April 9, 2013
INVENTOR(S) : Donald Richard Callentine and Anthony Thomas Iacovetti It is certified that error appears in the above-identified patent and that said Letters Patent is hereby corrected as shown below:

IN THE CLAIMS:

Claim 8, Column 7, Line 41: Change “barrier bracket” to -- barrier mountable bracket --.

Signed and Sealed this
Twenty-second Day of October, 2013

Teresa Stanek Rea
*Deputy Director of the United States Patent and Trademark Office*